US005417091A

United States Patent [19]

Moser

[11] Patent Number: 5,417,091

[45] Date of Patent: May 23, 1995

[54] REVERSE PATTERN TURN CUFF SOCK AND METHOD OF FORMING SAME

[75] Inventor: Alexander W. Moser, Elon College, N.C.

[73] Assignee: Knit-Tech, Inc., Elon College, N.C.

[21] Appl. No.: 257,804

[22] Filed: Jun. 10, 1994

[51] Int. Cl.[6] ..... D04B 1/10; D04B 1/26; A41B 11/00

[52] U.S. Cl. ..... 66/178 R; 66/183; 66/188; 66/199; 2/239; 2/90; 2/60; 2/242

[58] Field of Search ..... 66/170, 171, 172 R, 66/178 R, 183, 188, 189, 194; 2/60, 90, 123, 125, 239, 240, 242

[56] References Cited

U.S. PATENT DOCUMENTS

| | | | |
|---|---|---|---|
| 560,831 | 5/1896 | Barroll | 66/178 R X |
| 1,558,103 | 10/1925 | McClelland | 2/239 |
| 1,572,956 | 2/1926 | Rappaport | 2/239 |
| 2,236,763 | 11/1941 | Edwards | 66/178 R |
| 2,578,895 | 12/1951 | Meengs et al. | 566/178 R |
| 2,904,980 | 9/1959 | Stinson | 66/171 |
| 2,926,512 | 3/1960 | Robertson | 66/178 R |
| 2,934,923 | 5/1960 | Elwell | 66/188 |
| 2,979,927 | 4/1961 | Wakefield | 66/188 X |
| 3,039,282 | 6/1962 | Hayes | 66/178 |
| 3,289,329 | 12/1966 | Weiss | 66/171 X |
| 3,449,766 | 6/1969 | Garber et al. | 2/90 X |
| 3,511,053 | 5/1970 | Blizzard | 66/199 X |
| 3,990,115 | 11/1976 | Nester | 2/239 |
| 4,961,235 | 10/1990 | Williger | 2/239 |
| 5,133,091 | 7/1992 | del Valle Mas | 2/239 |
| 5,157,791 | 10/1992 | Woodson et al. | 2/239 |

*Primary Examiner*—John J. Calvert
*Attorney, Agent, or Firm*—Richard E. Jenkins

[57] ABSTRACT

A casual/dress sport sock having a leg-covering portion and a foot-covering portion wherein the knitting stitch pattern of the sock is reversed in the medial area of the leg-covering portion. Thus, the casual/dress sport sock in its extended position comprises a right side out foot-covering portion, a right side out lower area of the leg-covering portion, and a wrong side out upper area of the leg-covering portion. When cuffed, the sock comprises a uniform aesthetic knitting stitch pattern wherein the cuff portion, the lower area of the leg-covering and the foot-covering portion of the sock are all presented in right side out condition when worn on the foot.

10 Claims, 2 Drawing Sheets

REVERSE PATTERN TURN CUFF SOCK AND METHOD OF FORMING SAME

TECHNICAL FIELD

The present invention relates to an improvement in hosiery, and more particularly to an improvement in a knitted casual/dress sport sock of the type wherein the top is turned down upon itself to form a cuff.

BACKGROUND ART

Casual/dress sport socks or athletic socks are usually constructed without an external pattern thereon other than a rib or other knit stitch pattern so that the socks may be worn with the tops folded over into a cuff and the disparity in appearance between the wrong side out cuff portion and the right side out remaining portion of the sock will not be unacceptably obvious to the casual observer. Normally the casual/dress sport socks are worn by an individual during such exercise activities as aerobics, basketball, racquetball, weightlifting and the like. However, they have also become fashionable to wear with general sports attire and with casual or tennis shoes. Thus, there is a considerable advantage which would be provided by a knitted casual/dress sport sock construction which would have a uniform outside appearance after the top is folded over or rolled down to form a cuff since this would greatly improve the aesthetics of the casual/dress sport sock.

Prior art of interest includes U.S. Pat. No. 3,039,282 to Hayes (assigned to SportWear Hosiery Mills, Inc.) disclosing a reversible sock which enables patterns to be formed in the leg-covering portion of the sock so that the right side of the pattern will be exposed when a cuff is formed. The patent discloses taking a newly knitted bobby sock in right side out condition and then closing the toe opening with the wrong side of a looping seam on the right side of the foot-covering portion of the sock. Next, the sock is turned wrong side out so that the looping seam on the foot-covering portion of the sock will be right side out. Finally, the leg-covering portion of the sock is folded or triple rolled so that the right side of the leg-covering portion is displayed in the right side out condition while the foot-covering portion is in the wrong side out condition.

The pattern in the foot-covering portion is similar on both the wrong and right side thereof so that the sock as worn with the foot-covering portion in the wrong side out condition is acceptable, particularly since the looping seam has the right side exposed on the outer surface. Thus, the right side of the leg-covering portion of the sport or bobby sock is exposed when folded or triple rolled and the remaining portion of the sock has an acceptable appearance in view of the looping seam in the wrong side out foot-covering portion of the sock being reversed (right side exposed). Summarily, while recognizing the desirability of having the right side of the cuff of a sport sock exposed, the patent essentially provides for wearing the sock wrong side out in order to attempt to give such an appearance.

DISCLOSURE OF THE INVENTION

In accordance with the present invention, a knitted casual/dress sport sock is provided which comprises a foot-covering portion and a leg-covering portion wherein the foot-covering portion has a right side and a wrong side, and the right side of the foot-covering portion is on the outside of the sock when worn on the foot.

The leg-covering portion of the sock is knitted such that the bottom area thereof has the right side on the outside of the sock and the upper area thereof has the wrong side on the outside of the sock so that the upper area of the leg-covering portion may be rolled down into a cuff and the outside of the cuff will have substantially the same knit pattern appearance as the outside of the bottom area of the leg-covering portion and the outside of the foot-covering portion of the sock.

Also, applicant provides a method of making a knitted casual/dress sport sock which has a uniform outside pattern appearance after being cuffed. The method comprises knitted the leg-covering portion of the sock with the upper cuff-forming area thereof wrong side out when worn on the foot and the lower area right side out when worn on the foot, and knitting the foot-covering portion of the sock with the right side out when worn on the foot.

It is therefore the object of the present invention to provide a knitted casual/dress sport sock which has a more pleasing aesthetic appearance than previously known knitted sport socks.

It is another object of the present invention to provide a knitted casual/dress sport sock which provides substantially the same outside knit stitch appearance after the cuff is formed at the top of the leg-covering portion of the sock. Some of the objects of the invention having been stated, other objects will become evident as the description proceeds, when taken in connection with the drawings described in detail hereinbelow.

BEST MODE FOR CARRYING OUT THE INVENTION

Figure 1:
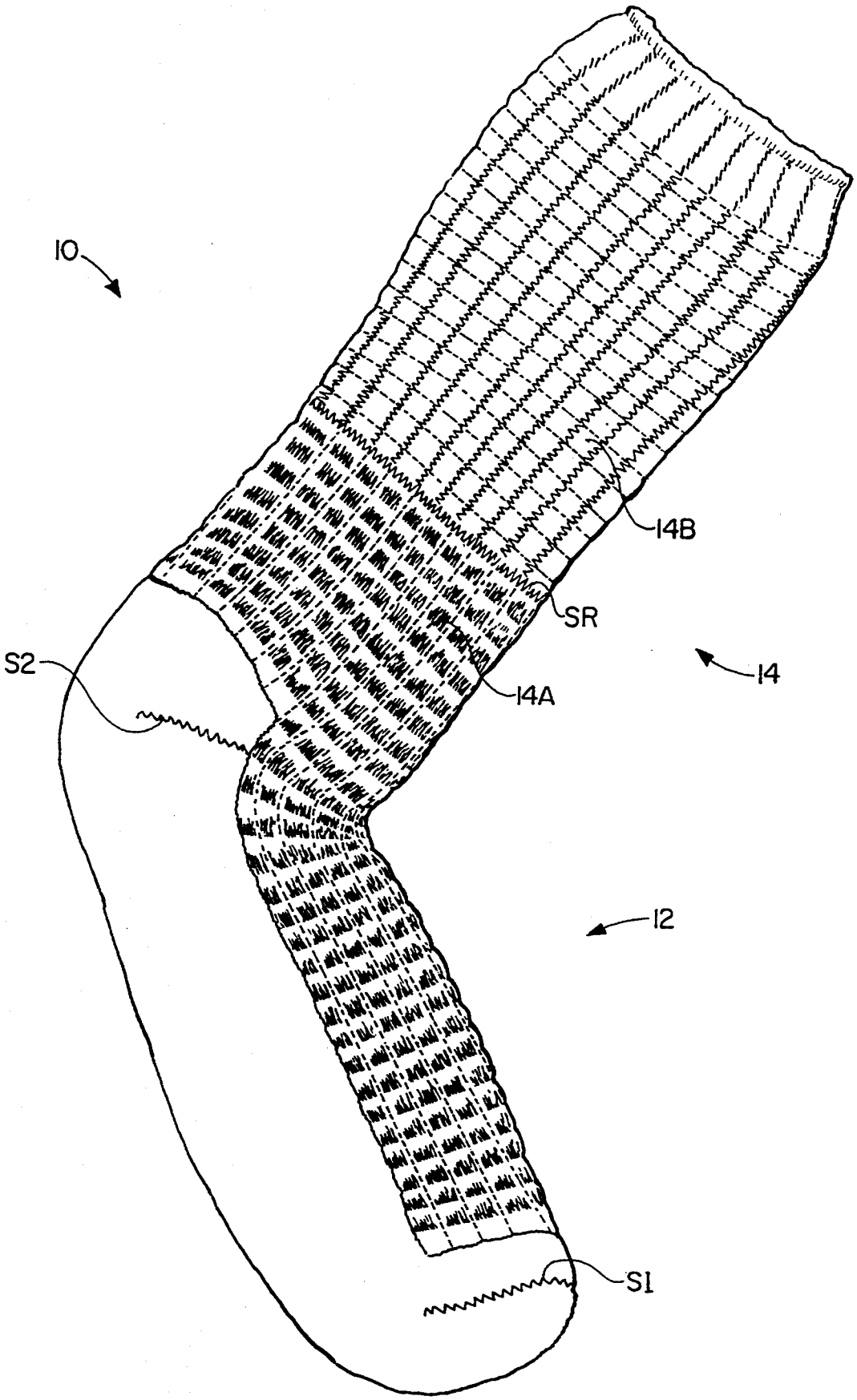
FIG. 1 is a side elevational view of a typical sport sock made in accordance with the present invention prior to formation of a cuff.
Figure 2:
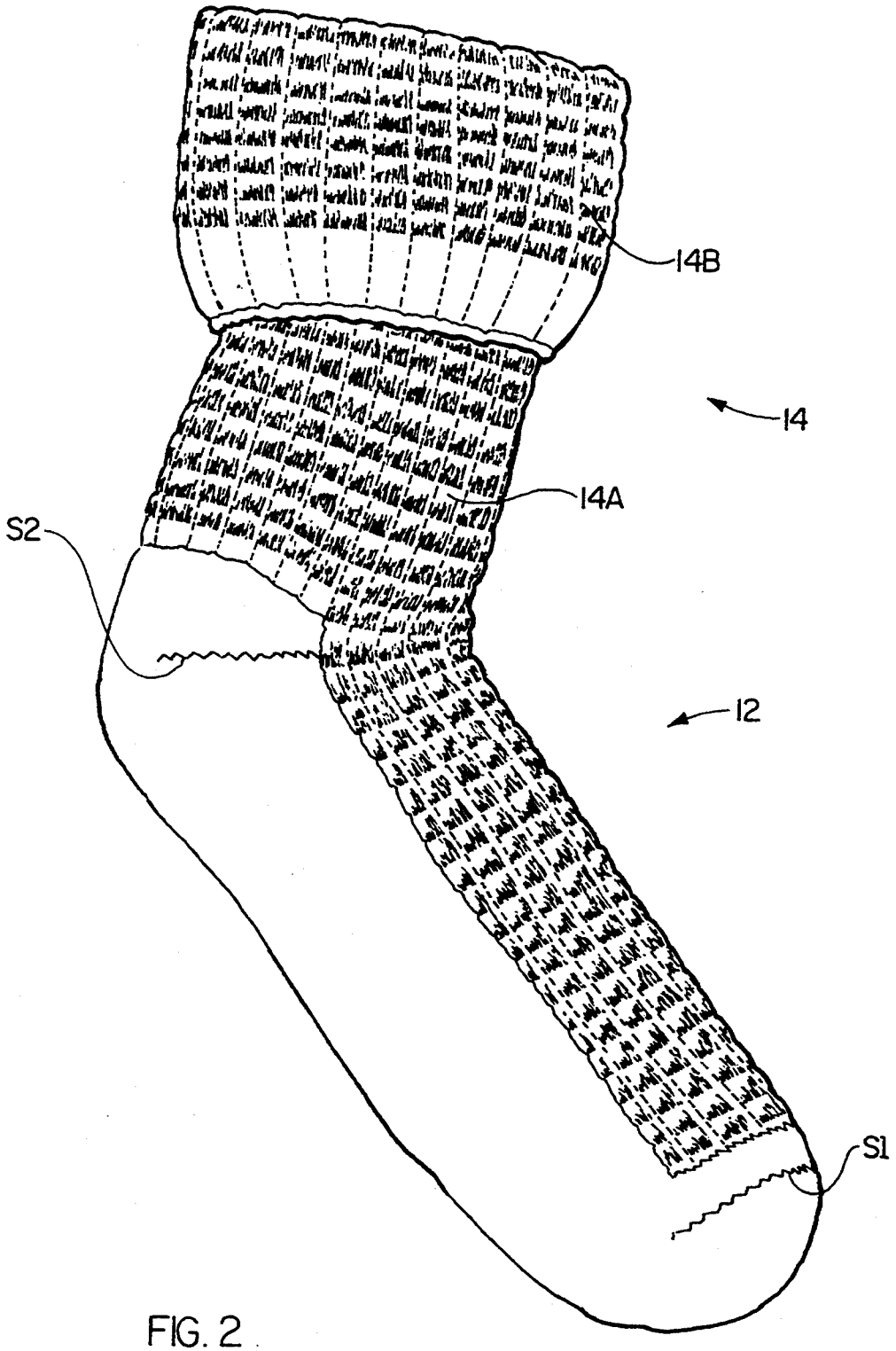
FIG. 2 is a side elevational view of the sock illustrated in FIG. 1 after the upper area of the leg-covering portion of the sock has been rolled down to form a cuff.

Referring now more specifically to the drawings, a preferred embodiment of the casual/dress sport sock of the present invention is shown in FIGS. 1–2 and generally designated 10. Casual/dress sport sock 10 can be knitted from any suitable material and in any of many alternative knit stitch constructions which would be known to one skilled in the hosiery art. Casual/dress sport sock 10 is formed from foot-covering portion 12 and leg-covering portion 14. Foot-covering portion 12 includes conventional toe seam S1 and heel seam 82. As can be seen in FIGS. 1–2, the upper surface of foot-covering portion 12 is formed with a stitch pattern having a technical face and a technical back (for example, a link stitch) which is identical to the stitch pattern of lower area 14A of leg-covering portion 14. The knitted stitch pattern is reversed at stitch course SR so that the upper area 14B of leg-covering portion 14 is formed with the stitch pattern reversed (or wrong side out) from the remaining portion of the sock.

In this fashion, sock 10 of the invention very advantageously provides for a uniform knit stitch pattern appearance when a cuff is formed by rolling down upper area 14B of leg-covering portion 14 of casual/dress sport sock 10. Heretofore, knitted sport socks when cuffed provided the undesirable effect of having the outer surface of the cuff exposing the wrong side of the knitting pattern while the remainder of the sock contrasted therewith by exposing the right side of the knitting pattern. The resulting discordant appearance can range from being only mildly noticeable to being quite visible depending on the type of knitting stitch pattern utilized to form sock 10.

Method of Knitting

The reverse pattern turn cuff sock of the present invention is most suitably knit on a conventional circular knitting machine in a right side out configuration. Next, it is turned wrong side out by the knitting technician when the sock is removed from the knitting machine, and the wrong side out sock is then taken to the looping department where the toe and heel are closed by a toe seam and heel seam, respectively. Finally, the sock is turned right side out to be inspected and finished for packaging.

Applicant's novel process involves similar conventional knitting of sock 10 except that the right side out pattern is knitted for the entire foot-covering portion 12 of sock 10 and the first or lower area 14A of leg-covering portion 14. At a medial location SR in leg-covering portion 14 the knitting pattern is reversed and the upper area 14B of leg-covering portion 14 is knitted in a wrong side out condition. Subsequent to the knitting of sock 10, the remaining fabrication steps of sock 10 are conventional and would be well known to one skilled in the hosiery art.

Although other circular hosiery knitting machines could be utilized in the process of the invention, applicant contemplates that casual/dress sport sock 10 is most advantageously knitted on a LONATI JUNIOR EL double cylinder knitting machine. Also, although many different knit pattern constructions of sock 10 are contemplated as within the scope of the present invention, the following link pattern knitting construction is believed to be representative:

EXEMPLARY CONSTRUCTION

A. 4 course welt (rib)

B. 12 course 2×2 (rib) top

C. 68 courses of pattern (links)—Upper Area of Leg-Covering Portion

D. Pattern reversed

E. 32 courses of pattern (links)—Lower Area of Leg-Covering Portion

F. 80 courses of pattern (links)—Foot-Covering Portion

G. 10 courses of plain (rib) toe wherein in the upper area of the leg covering portion the knit stitch pattern is a four (4) course repeat four (4) needles wide with three (3) needles in the bottom cylinder and one (1) needle in the top cylinder knitting and wherein every fourth course all needles go to the top cylinder. The knit stitch pattern for the lower area of the leg-covering portion is the reverse pattern thereof.

The new process enables casual/dress sport sock 10 to be formed from substantially any conventional knitting stitch pattern and, when worn in a cuffed condition, the right side of the knitting stitch pattern will be exposed on the entirety of the outside of sock 10 so as to provide a pleasing aesthetic appearance. This is achieved by applicant's novel concept for reversing the knitting stitch pattern in the medial portion of the leg-covering portion of the sock as described in detail hereinabove.

It will be understood that various details of the invention may be changed without departing from the scope of the invention. Furthermore, the foregoing description is for the purpose of illustration only, and not for the purpose of limitation—the invention being defined by the claims.

What is claimed is:

1. A sock comprising a foot-covering portion formed of knit fabric, said knit fabric having a technical face and a technical back and a leg-covering portion, having a right side and a wrong side with said right side being on the outside of said foot covering portion when worn, and said leg-covering portion having a bottom area and an upper area, said bottom area having the right side on the outside when worn and said upper area knitted with the technical face in opposition to the bottom area, the bottom and upper areas being formed as one continuous knitted fabric, whereby the upper area of said leg-covering portion may be rolled down into a cuff and the outside of the cuff will have substantially the same knit pattern appearance as the outside of the bottom area of said leg-covering portion and the outside of said foot-covering portion of said sock.

2. A sock according to claim 1 wherein the knit reverses in medial portion of said leg-covering portion of said sock so that the upper area of said leg-covering portion comprises about $\frac{2}{3}$ thereof and the lower area of said leg-covering portion comprises about $\frac{1}{3}$ thereof.

3. A sock according to claim 2 wherein said sock is formed with a link knit pattern construction.

4. A knitted casual/dress sport sock according to claim 2 wherein the upper area of said leg-covering portion comprises 68 knit pattern courses, the lower area of said leg-covering portion comprises 32 knit pattern courses, and said foot-covering portion comprises 80 knit pattern courses.

5. A knitted sock comprising a foot-covering portion and a leg-covering portion, said sock having a link pattern knitted right side and wrong side with said right side being on the outside of said foot-covering portion when worn, and said leg-covering portion being link pattern knitted such that a bottom one-third area thereof has the right side on the outside of said sock and an upper two-third area thereof has the wrong side on the outside of said sock when worn on the foot, whereby the upper area of said leg-covering portion may be rolled down into a cuff and the outside of the cuff will have substantially the same link knit pattern appearance as the outside of the bottom area of said leg-covering portion and the outside of said foot-covering portion of said sock.

6. A method of making a knitted sock which will have a uniform outside pattern appearance after being cuffed, the method comprising knitting a leg-covering portion of said sock with a upper area thereof having a pattern, reversing the pattern in a lower area of the lower leg-covering portion and a foot-covering portion of said sock and forming a toe portion.

7. A method according to claim 6 including reversing the knit pattern in a medial portion of said leg-covering portion of said sock so that the upper area of said leg-covering portion comprises about two-third thereof and the lower area of said leg-covering portion comprises about one-third thereof.

8. A method according to claim 7 including knitting said sock with a link knit pattern construction.

9. A method according to claim 7 including knitting 68 courses for the upper area of said leg-covering portion, knitting 32 courses for the lower area of said leg-covering portion, and knitting 80 courses for said foot-covering portion.

10. A method of making a knitted sock having a uniform outside pattern appearance after being cuffed, the method comprising link pattern knitting a leg-covering portion of said sock with an upper two-thirds area having a technical face and a technical back, knitting a lower one-third area with the technical face and the technical back reversed from the upper area, link pattern knitting a foot-covering portion of said sock with the technical face and back the same as the lower area of the leg-covering portion, and forming a toe portion.

* * * * *